US005118033A

United States Patent [19]

Kula

[11] Patent Number: 5,118,033

[45] Date of Patent: Jun. 2, 1992

[54] TRIANGULAR SHAPED CARTON

[76] Inventor: Gregory R. Kula, 1200 Itasca Rd., Addison, Ill. 60101

[21] Appl. No.: 785,482

[22] Filed: Nov. 1, 1991

[51] Int. Cl.[5] ..... B65D 5/20; B65D 43/16

[52] U.S. Cl. ..... 229/115; 206/551; 229/126; 229/148

[58] Field of Search ..... 229/115, 126, 148; 206/551

[56] References Cited

U.S. PATENT DOCUMENTS

| | | | |
|---|---|---|---|
| 1,814,561 | 7/1931 | Krumm | 229/115 |
| 2,072,753 | 3/1937 | Ikeda et al. | 229/148 |
| 3,295,740 | 1/1967 | Hall | 229/148 |
| 3,357,544 | 12/1967 | Gingher | 229/115 |
| 3,623,650 | 11/1971 | Watts | 229/148 |
| 4,042,166 | 8/1977 | Selin et al. | 229/148 |
| 4,134,533 | 1/1979 | Heavner | 229/148 |
| 4,471,902 | 9/1984 | Skaggs | 229/148 |
| 4,804,136 | 2/1989 | Hall | 229/126 |

FOREIGN PATENT DOCUMENTS

| | | | |
|---|---|---|---|
| 2312859 | 9/1974 | Fed. Rep. of Germany | 229/148 |

*Primary Examiner*—Gary E. Elkins
*Attorney, Agent, or Firm*—Douglas B. White

[57] ABSTRACT

The present invention comprises a one-piece blank for forming a shallow triangular carton. The blank includes a bottom portion having converging paired sidewalls hinged thereto. A third wall is hinged to the bottom and to a cover. In one embodiment the paired sidewalls have upwardly protruding tabs for engaging the cover, and the cover exhibits tab engaging openings therein. In another embodiment, the cover openings converge to define a flexing peripheral edge for frictionally engaging the sidewalls at their conjunction.

6 Claims, 4 Drawing Sheets

TRIANGULAR SHAPED CARTON

BACKGROUND OF THE INVENTION

1. Field of the Invention

This invention relates generally to packaging of the type used for food products. More particularly, this invention relates to containers which are formed from a single blank into a triangular shaped carton.

2. Description of the Prior Art

Cartons used for the packaging of food products, and particularly flat products such as pizza, require a design which is not only economical to manufacture but easy to assemble at the point of purchase. The fast food and pizza industries have developed a unique and intense demand for such cartons to facilitate the carry-out sale of products. An example of a carton designed for a full size pizza is shown and described in U.S. Pat. No. 4,765,534. This carton is formed from a one-piece scored blank which folds to form a bottom, hinged sidewalls and a cover. Most importantly, corner formations are constructed to engage the pizza to prevent shifting as well as to provide support to the carton.

Recently there has been a growing trend toward the retail of smaller portions, such as a single slice of pizza, pie or similar items. However, no prior art package has been successfully developed for the smaller, wedge shaped products, which is economical, yet effective and easy to assemble.

SUMMARY OF THE INVENTION

The present invention comprises a one-piece blank for forming a shallow carton of a generally triangular shape. The blank includes a bottom portion having paired sidewalls hinged thereto. A third wall is hinged to the bottom and to the cover. In one feature the paired sidewalls employ tabs (or corner portions) for engaging the cover, and the cover exhibits tab engaging openings therein. In another feature, the cover openings converge to define a hinged edge for frictionally engaging the sidewalls at their convergence.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Turning now to the drawings, FIGS. 1, 4, 8 and 11 depict alternative versions of the triangular carton of the present invention. These cartons are easily assembled from a simple one-piece blank to form a sturdy carton for a single slice of pizza or similar wedge shaped food product. Moreover, due to the unique cover closure design, the carton is secured and the cover is restrained with a single motion.

Figure 1:
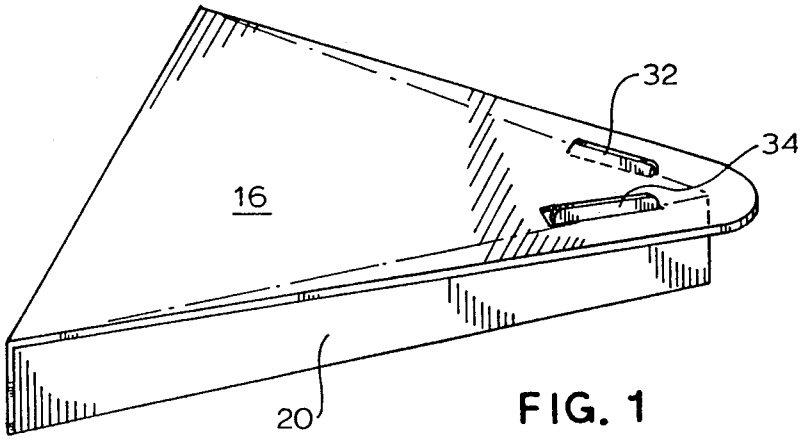
FIG. 1 is a perspective view of a preferred embodiment of the carton of the present invention, as assembled.
Figure 2:
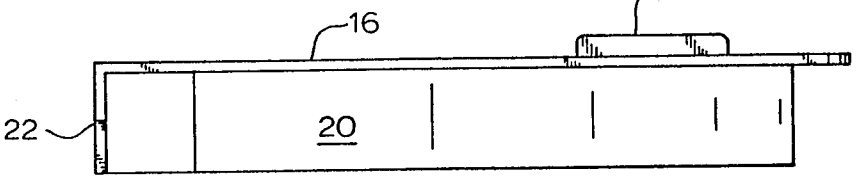
FIG. 2 is a side view of the carton embodiment of FIG. 1.
Figure 3:
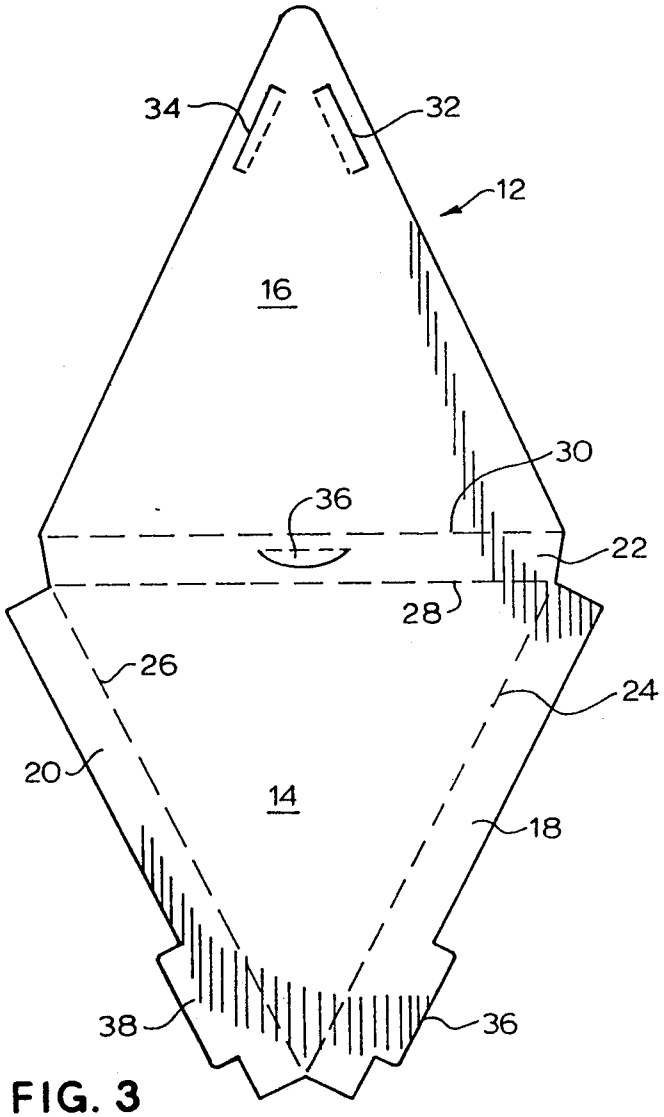
FIG. 3 is a plan view of the blank for the carton embodiment of FIG. 1.
Figure 4:
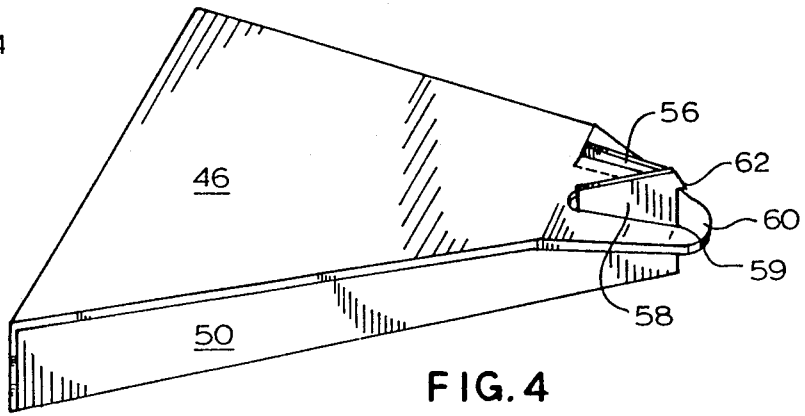
FIG. 4 is a perspective view of a second embodiment of the carton of the present invention, as assembled.
Figure 5:
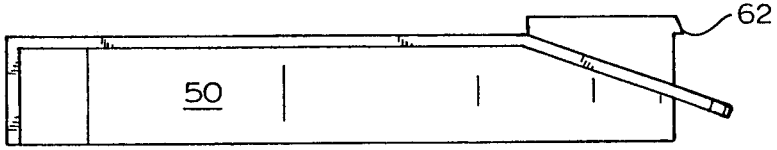
FIG. 5 is a side view of the carton embodiment of FIG. 4.
Figure 7:
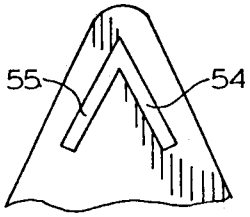
FIG. 7 is a plan view of an alternative cut-out in the corner of the blank of FIG. 4.
Figure 6:
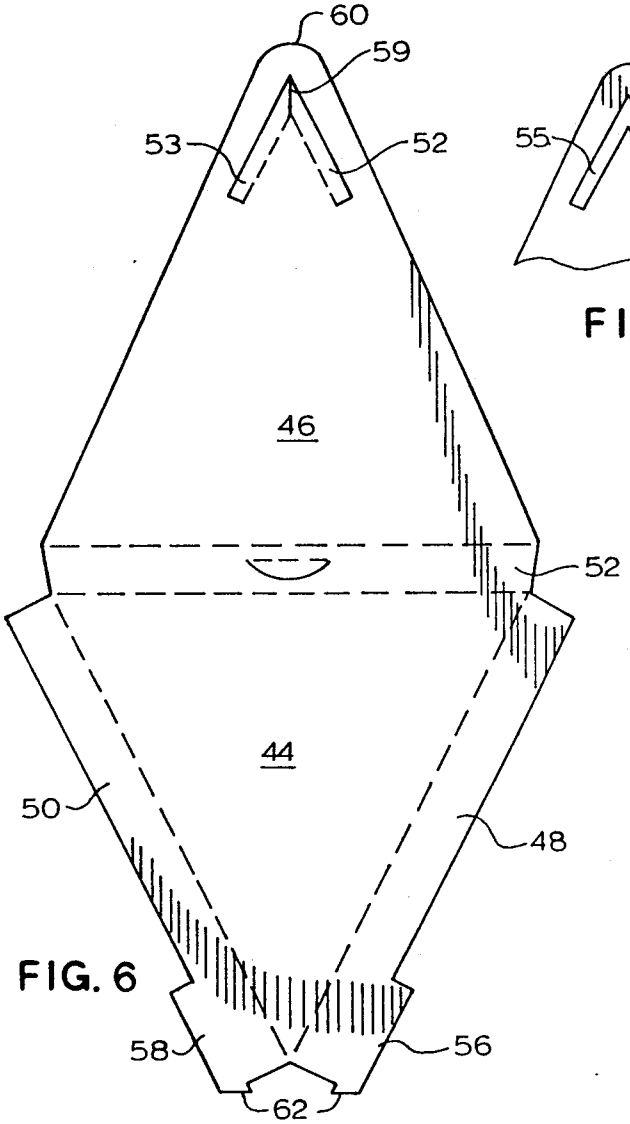
FIG. 6 is a plan view of the blank for the carton embodiment of FIG. 4.
Figure 8:
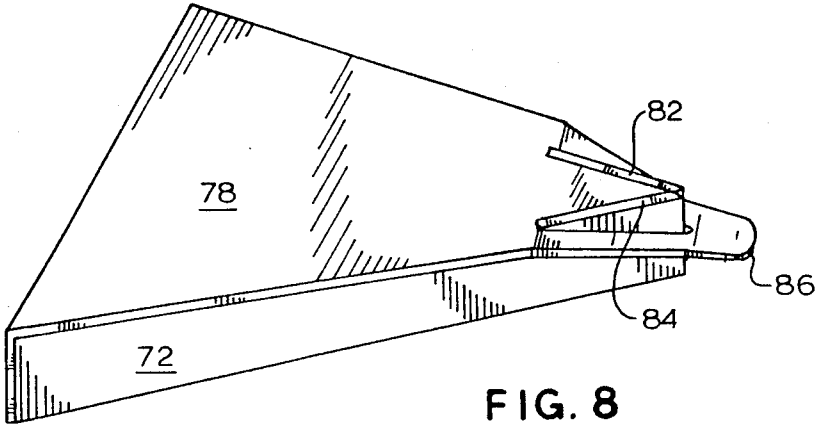
FIG. 8 is a perspective view of another embodiment of the carton of the present invention, as assembled.

In one embodiment, shown in FIGS. 1–3, a one-piece blank 12 is assembled into the triangular carton of FIGS. 1 and 2. This blank is defined into a bottom portion 14, a top portion 16 (cover), paired sidewalls 18 and 20, and a hinged third wall 22 connecting the bottom portion to the cover. Construction is accomplished by first folding the paired sidewalls perpendicularly to the bottom portion along creased or scored lines 24 and 26, folding the third wall perpendicularly to the bottom along line 28, and folding the cover perpendicular to the third wall along line 30.

To secure the carton and cover there is provided hinged rectangular slots 32 and 34 positioned in the cover to accept tabs 36 and 38 projecting upwardly from the sidewalls 18 and 20. Consequently, after the basic folds are made, and the optional hinged vent 36 is opened, the cover is simply pressed onto the tabs to both complete the carton and to secure its closure by employing a friction fit of the sidewall tabs within the hinged cover slots.

Figure 9:
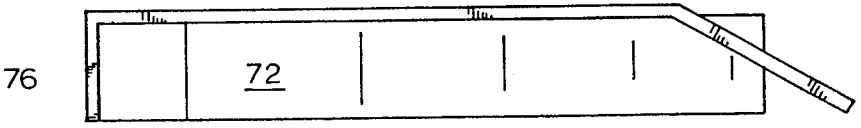
FIG. 9 is a side view of the embodiment of the carton of FIG. 8.
Figure 10:
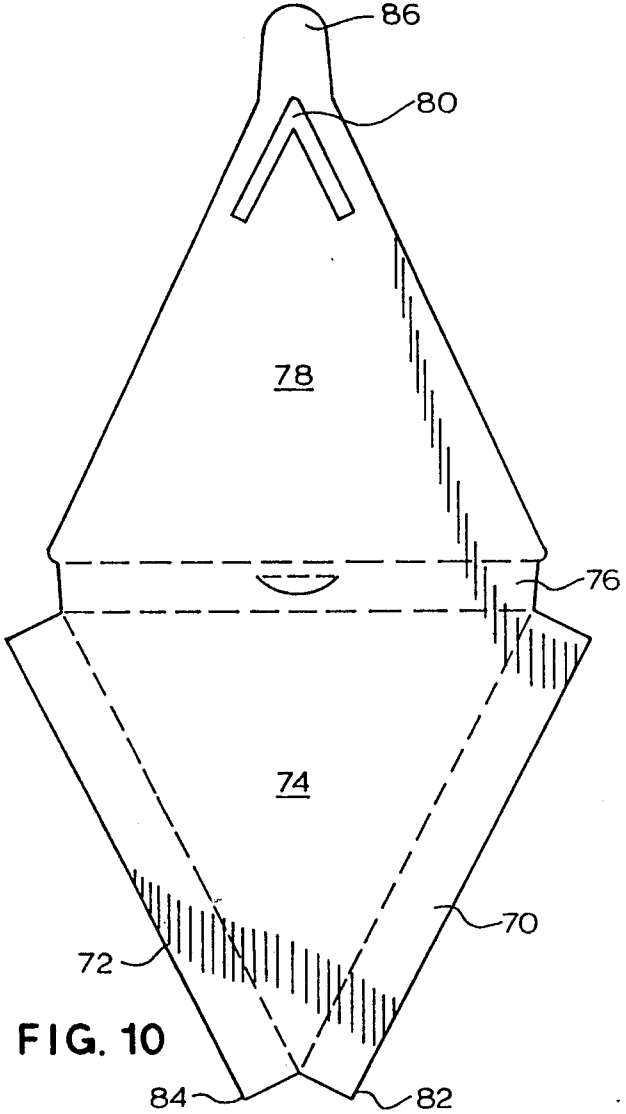
FIG. 10 is a plan view of a blank for the embodiment of the carton of FIG. 8.
Figure 11:
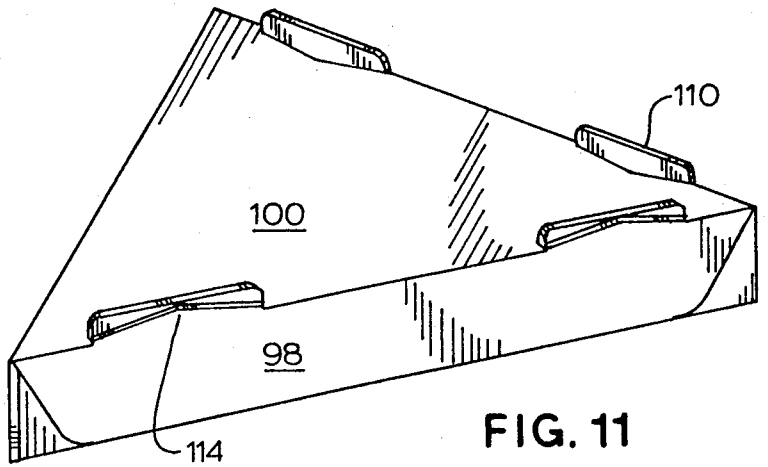
FIG. 11 is a perspective view of another embodiment of the carton of the present invention.

In a second embodiment (FIGS. 4–7) the tab engaging slots in the cover portion of the carton are joined at one end to form a continuous angled slot, and the sidewall tabs are shifted forward to align with the slots. As before, a blank is prepared having defined thereon a bottom portion 44, a cover 46, paired sidewalls 48 and 50 and a third wall 52 hingedly connecting the bottom portion to the cover. To assemble the carton, the sidewalls are folded as before to bring the tabs 56 and 58 together and into registration with slots 52 and 53 in the cover. These slots may be cut along three sides to form hinged openings (FIG. 9) or cut along all four sides to form full cut-outs 54 and 55 shown in FIG. 10. With the slots 52 and 53 (or 54 and 55) connecting at their forward extremity 59, a continuous angled slot is formed; and when the cover is pressed upon the tabs, the peripheral portion 60 flexes downwardly to frictionally engage the forward edge of the converged sidewalls. And to further lock the carton, a lobe 62 is formed at the upper extremity of the tabs and angled downwardly to allow the apex 59 of the angled slot in the cover to pass in its downwardly movement, but to catch on the lobe to prevent an upwardly movement.

In yet another version of the carton (FIGS. 8–10) the cover closure feature is further simplified. As in the previous embodiments, paired sidewalls 70 and 72 are hinged to the bottom 74 and a third wall 76 hinges the bottom to the cover 78. Also, as before, an angled slot 80 is positioned in registration with the converged sidewalls; but in this embodiment no separate tabs are formed on the upper edges of the sidewalls. As is readily apparent in FIGS. 8 and 9, the corners 82 and 84 of the paired sidewalls protrude and engage the cut-out slot of the cover in a manner similar to that of the separately formed tabs in FIG. 4. Assembly requires folding of the sidewalls along the creased or scored lines, but in this embodiment the cover is positioned to overlie the paired sidewalls. Thereafter, pressure on the protruding extremity 86 of the cover causes it to flex downwardly to frictionally engage the upper corners of the converged edges of the paired sidewalls.

Figure 12:
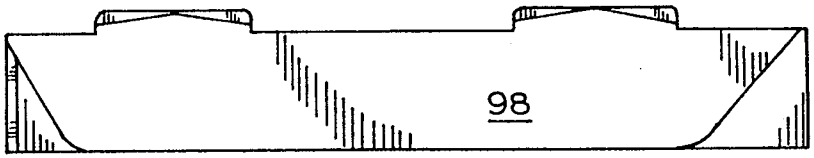
FIG. 12 is a side view of the embodiment of the carton of FIG. 11.
Figure 13:
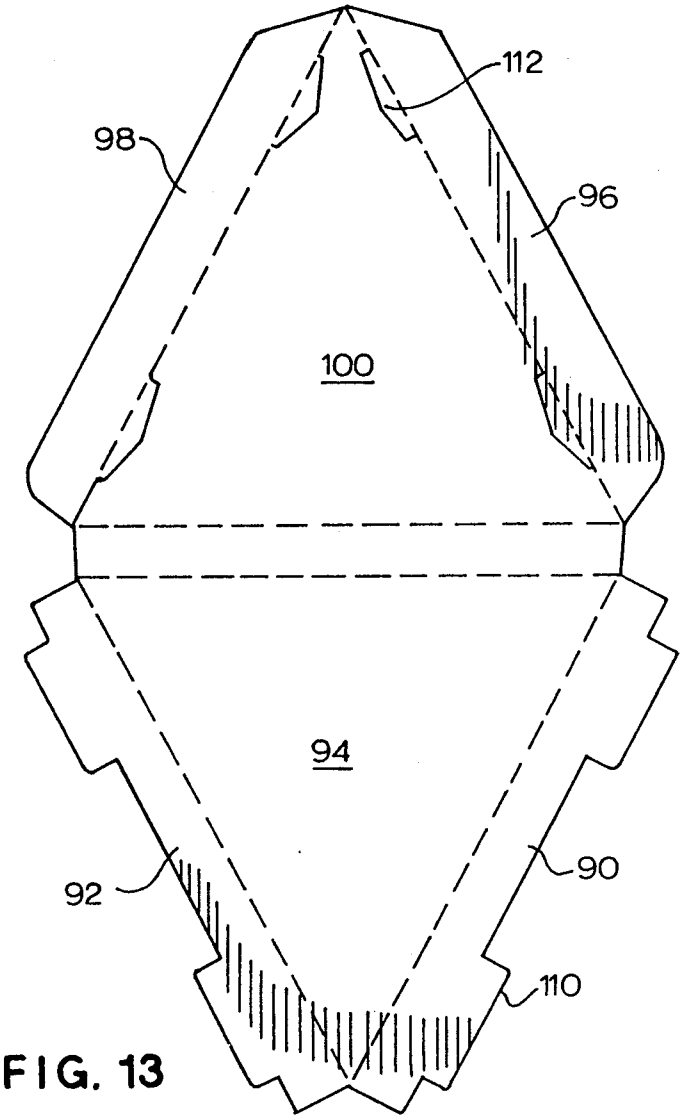
FIG. 13 is a plan view of a blank for the embodiment of the carton of FIG. 11.

In yet another version of this carton (FIGS. 11–13) side flaps extend from the cover and lock into place when the cover is closed. As in previous embodiments, paired sidewalls 90 and 92 are hinged to the bottom portion 94. But in this embodiment, paired side flaps 96 and 98 are hinged to the cover 100. Tabs 110 are formed to project from the lower sidewalls and to engage slots 112 formed in the cover. The slots 112 leave tabs 114 affixed to the side flaps. During assembly, after the basic folds are accomplished, the cover is pressed into place over the tabs projecting from the sidewalls. And as these tabs are pushed through the cut-outs in the cover, they contact the tabs 114 extending from the side flaps to force the flaps tight against the sides of the carton.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A carton comprising:

a bottom portion;

a pair of converging sidewalls hingedly connected to said bottom portion, said sidewalls having cover engaging portions defined thereon;

a third wall hingedly connected to said bottom portion;

a cover portion hingedly connected to said third wall, said cover having an opening forming an angled slot therein, said opening defining a portion of said cover peripheral to said angled slot for engaging said cover engaging portions of said sidewalls; and said angled slot being positioned in registration with said converging sidewalls at their convergence, whereby said portion of said cover peripheral to said angled slot frictionally engages said cover engaging portions of said converging sidewalls.

2. The carton of claim 1 wherein a sloping lobe is defined upon the converging sidewalls to provide a catch to secure said peripheral cover portion thereon.

3. A closure feature for a carton having converging sidewalls and a hinged cover, said closure feature comprising:

cover engaging portions defined on said sidewalls; and an opening in said cover forming an angled slot, said opening defining a portion of said cover peripheral to said angled slot, and positioned in registration with said converging sidewalls at their convergence, whereby said portion of said cover peripheral to said angled slot frictionally engages said cover engaging portions of said converging sidewalls.

4. The closure feature for a carton having converging sidewalls and a hinged cover of claim 3 wherein a sloping lobe is defined upon the converging sidewalls to provide a catch to secure said peripheral cover portion thereon.

5. A carton blank comprising:

a bottom portion defined on said carton blank;

paired converging sidewall portions defined on said carton blank and connected to said bottom portion, said converging sidewall portions presenting cover engaging portions thereon;

a third wall portion defined on said carton blank and connected to said bottom portion;

a cover portion defined on said carton blank and connected to said third wall portion wherein said cover exhibits an opening which forms an angled slot, defining a portion of said cover peripheral to said angled slot, whereby said angled slot is positioned in registration with said sidewalls at their convergence upon assembly and said portion of said cover peripheral to said angled slot is positioned to frictionally engage said cover engaging portions of said converging sidewalls.

6. The carton blank of claim 5 wherein a sloping lobe is defined upon the converged edges of said sidewalls to provide a catch to secure said peripheral cover portion thereon.

* * * * *